US007205023B2

(12) United States Patent
Verhaverbeke et al.

(10) Patent No.: US 7,205,023 B2
(45) Date of Patent: Apr. 17, 2007

(54) METHOD AND APPARATUS FOR CHEMICAL MIXING IN A SINGLE WAFER PROCESS

(75) Inventors: Steven Verhaverbeke, San Francisco, CA (US); J. Kelly Truman, Morgan Hill, CA (US); Rick R. Endo, San Carlos, CA (US); Alexander Ko, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 278 days.

(21) Appl. No.: 09/891,833

(22) Filed: Jun. 25, 2001

(65) Prior Publication Data

US 2002/0075750 A1 Jun. 20, 2002

Related U.S. Application Data

(60) Provisional application No. 60/214,056, filed on Jun. 26, 2000.

(51) Int. Cl.

| | |
|---|---|
| ***B05D 3/12*** | (2006.01) |
| ***B05D 1/34*** | (2006.01) |
| ***B01F 5/04*** | (2006.01) |
| ***B08B 3/00*** | (2006.01) |
| ***B08B 3/04*** | (2006.01) |

(52) U.S. Cl. ..... 427/240; 427/426; 137/896; 134/36; 134/100.1

(58) Field of Classification Search ..... 427/8, 427/240, 421, 426; 251/149; 134/33, 36, 134/94.1, 98.1, 99.2, 100.1, 149, 153, 157, 134/902; 137/896, 897, 898, 602, 3; 156/345.18, 156/345.21, 345.29

See application file for complete search history.

(56) References Cited

U.S. PATENT DOCUMENTS

| | | | | |
|---|---|---|---|---|
| 3,045,702 | A * | 7/1962 | Nakata | 137/625.48 |
| 3,291,347 | A * | 12/1966 | Blades | 222/136 |
| 4,243,071 | A * | 1/1981 | Shackelford | 137/625.46 |
| 4,778,532 | A | 10/1988 | McConnell et al. | |
| 4,899,767 | A * | 2/1990 | McConnell et al. | 134/56 R |

(Continued)

OTHER PUBLICATIONS

Patent Abstracts of Japan, vol. 004, No. 089 (C-016), Jun. 25, 1980 & JP 55 051427 A (Sakaoka Kazuhiko), Apr. 15, 1980, 1 page.

(Continued)

*Primary Examiner*—Fred J. Parker
*Assistant Examiner*—David Turocy
(74) *Attorney, Agent, or Firm*—Blakely Sokoloff Taylor & Zafman

(57) ABSTRACT

A method of and apparatus for mixing chemicals in a single wafer process. According to the present invention a chemical is fed into a valve system having a tube of a known volume. The chemical is fed into the valve system to fill the tube with a chemical to generate a measured amount of the chemical. The measured amount of chemical is then used in a single wafer process.

14 Claims, 5 Drawing Sheets

U.S. PATENT DOCUMENTS 5,996,595 A 12/1999 Olesen et al.
6,132,522 A * 10/2000 Verhaverbeke et al. ..... 134/26
5,071,547 A * 12/1991 Cazer et al. ..... 210/198.2
5,134,445 A * 7/1992 Toge ..... 356/336
5,346,302 A * 9/1994 Ryu ..... 366/101
5,490,611 A * 2/1996 Bernosky et al. ..... 222/1
5,908,509 A 6/1999 Olesen et al.
5,938,847 A * 8/1999 Akimoto et al. ..... 118/665
5,972,123 A * 10/1999 Verhaverbeke ..... 134/3

OTHER PUBLICATIONS

Search Report for PCT/US/01/20469 mailed Feb. 14, 2002, 8 pages.
Written Opinion for PCT/US/01/20469 mailed Jun. 30, 2004, 5 pages.

* cited by examiner

METHOD AND APPARATUS FOR CHEMICAL MIXING IN A SINGLE WAFER PROCESS

This application claims the benefit of provisional application Ser. No. 60/214,056 filed Jun. 26, 2000 entitled METHOD AND APPARATUS FOR CHEMICAL MIXING IN A SINGLE WAFER PROCESS.

BACKGROUND OF THE INVENTION

1. Field of the Invention

The present invention relates to the field of semiconductor manufacturing and more specifically to a method and apparatus for mixing a precise amount of chemicals in a single wafer process.

2. Discussion of Related Art

Wet etching and wet cleaning of silicon wafers is typically done by immersing the wafers into a liquid. This can also be done by spraying a liquid onto a wafer or a batch of wafers. Wet wafer cleaning and etching is traditionally done in a batch mode. Because of the need for a shorter cycle time in chip manufacturing, there is a need for fast single wafer processing. When using single wafer processing, the amount of chemicals in processes is much smaller than when using batch processing. Even though the quantities in use at any time are much smaller than in batch processing, the accuracy of mixing has to be similar to batch processing.

When performing wet etching operations, the accuracy of the etch has to be smaller than 1% 1 sigma total variation on a 300 mm wafer. This variation is the result of variations in contact time over the wafer when spraying chemicals, the variation in temperature in the etching chemical and on the wafer surface and the variation in chemical concentration. Therefore the variation in chemical concentration has to be controlled very tight. When using wet chemicals for cleaning instead of etching wafers, the accuracy of mixing can be relaxed. Traditionally, in batch equipment, the chemicals are premixed in an off-line tank, where water and chemicals are added separately. Usually, at first chemicals are added and the amount is monitored by monitoring the level. Then the water is added to the full level. The chemicals in this off-line tank can be heated and when needed are transferred to the etching or cleaning tank. Inside the tank the concentration can be monitored and additional chemical or water can be added to adjust for any variations. Alternatively, such as in a flow-through reactor (e.g. CFM Technologies), chemicals are measured in a tube in which the level is monitored and are injected in a stream of DI water of which the flow is controlled. These techniques work well for mixing chemical volumes of the order of 1 to 41 of chemicals with multiple volumes of DI water.

Most single wafer wet processors available today use a similar principle. I.e., chemicals are premixed in an off-line tank and then are pumped to the single wafer chamber when needed. The problem with this approach is that for every mixing ratio of chemical, a specific mixing tank has to be constructed and chemicals have to be mixed in quantities far exceeding the necessary amount for the processing of one wafer.

Thus, there is a need for a simple and accurate mixing system coupled to a single wafer wet processing chamber that can be connected to the bulk supply of the semiconductor fab directly, without the use of a big pre-mixing tank for multiple wafer processing

SUMMARY OF THE INVENTION

A method of and apparatus for mixing chemicals in a single wafer process. According to the present invention a chemical is fed into a valve system having a tube of a known volume. The chemical is fed into the valve system to fill the tube with a chemical to generate a measured amount of the chemical. The measured amount of chemical is then used in a single wafer process.

DETAILED DESCRIPTION OF THE PRESENT INVENTION

The present invention is a method and apparatus for chemical mixing in a single wafer process. In the following description a number of specific details are set forth in order to provide a thorough understanding of the present invention. One of ordinary skill in the art will understand that these specific details are for illustrative purposes only and are not intended to limit the scope of the present invention. Additionally, in other instances, well-known processing techniques and equipment have not been set forth in particular detail in order to not unnecessarily obscure the present invention.

The present invention describes a method and apparatus for mixing a precise amount of chemicals in a single wafer process. The present invention utilizes a 6-port valve to accurately measure precise amounts of a chemical in a chemical mix or supply system. Because small amounts of chemicals can be precisely measured with a 6-port valve, the present invention provides a simple and accurate mixing system for single wafer processing where very small amounts of chemicals are used. The 6-port valve mixing apparatus of the present invention can be used to mix chemicals during or before use in a single wafer process.

Figure 1:
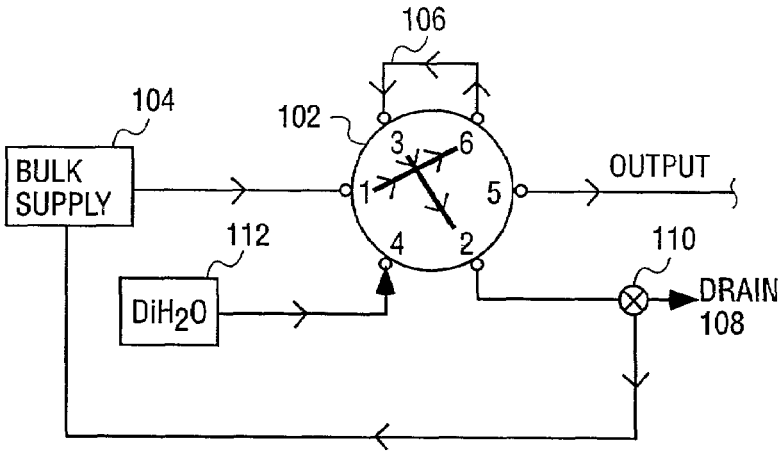
FIG. 1 is an illustration of a mixing apparatus in which a 6-port valve is being charged.

FIG. 1 is an illustration of a chemical mixing system which utilizes a 6-port valve 102. A 6-port valve is a valve system which has six individual ports (1–6) and which contains two internal tube connections coupling two sets of ports. In FIG. 1, ports 3 and 2 are connected together by an internal connection as are ports 1 and 6. The position of 6-port valve 102 in FIG. 1 is known as the "charging" position and is the position in which a known amount of chemical from a bulk supply 104 can be measured. Bulk supply 104 is coupled to port 1 of valve 102 and chemicals flow into port 1 and through an internal tube connection to port 6. The chemicals flow into an external measuring tube 106 externally connected between ports 3 and 6, and then flows out into port 3 and through an internal connection in valve 102 to port 2 and then out to a drain or valved 110 back into bulk supply 104.

In the present invention measuring tube 106 has a precisely known volume, so that when it is filled or "charged" measuring tube 106 contains a precise amount of chemicals. The amount of chemicals can be varied by changing the volume of measuring tube 106 between ports 3 and 6.

Figure 2:
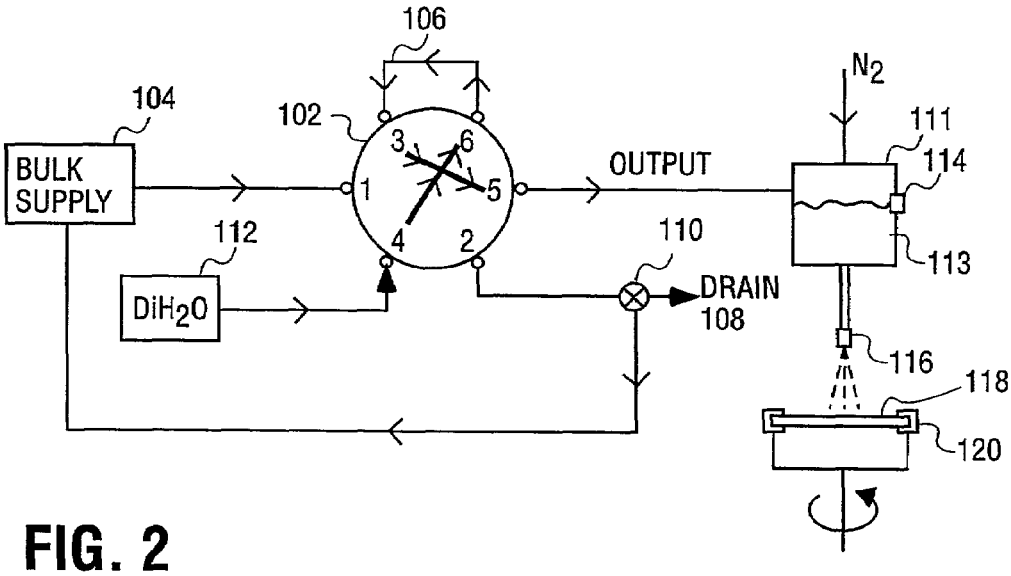
FIG. 2 is an illustration of a mixing apparatus which is ready for use.

Next, as shown in FIG. 2 the six port valve is turned ⅙th clockwise so that now port 3 is connected by an internal tube to port 5 and port 6 is connected by an internal tube to port 4. After turning valve 102 a ⅙th turn clockwise, there is now a very precise amount of chemical from bulk supply 104 contained in tube 106. This precisely measured amount of chemical is now ready for use in one of several different methods.

In one embodiment of the present invention as shown in FIG. 2, a bulk supply of water 112 which is to be mixed with the chemical liquid from bulk supply 104 is coupled to port 4 of 6-port valve 102. DI water flows through port 4 through the internal conduit to port 6 where it pushes out the precisely measured amount of chemical in measuring tube 106 through port 6 to port 3 as shown in FIG. 2. Coupled to port 5 is a reservoir or chamber 111. DI water pushes the precisely measured amount chemical into reservoir 111. DI water is continually fed into the reservoir 111 until a preset level is reached as indicated by a level sensor 114. In this way, a precise amount of chemical can be mixed with DI water to form a chemical mixture 113.

In an embodiment of the present invention as shown in FIG. 2, the chamber 111 is pressurized with an inert gas, such as $N_2$, to push the chemical mixture 113 contained in reservoir 111 through a dispenser or spray nozzle 116 onto a wafer 118 which is attached to a spinning or rotating support 120.

Figure 3:
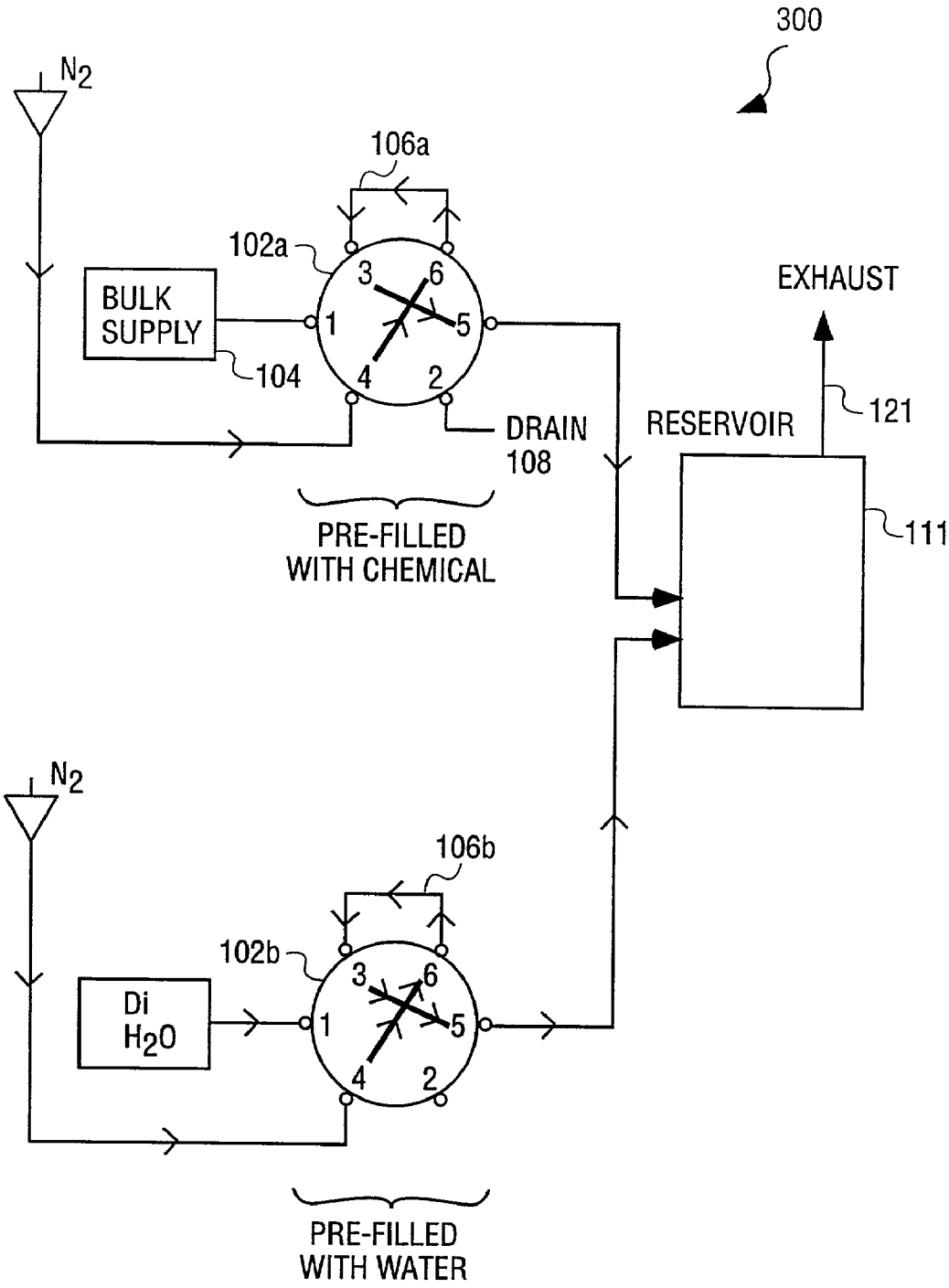
FIG. 3 is an illustration of a mixing apparatus which utilizes two 6-port valves.

FIG. 3 illustrates a mixing system 300 and method which can be used to precisely mix a chemical with DI water. In system 300 shown in FIG. 3, one 6-port valve 102*a* is used to provide a precise amount of a chemical to reservoir or chamber 111 and the second 6-port valve 102*b* is used to provide a precise amount of DI water to reservoir 111. Valve 102*a* and valve 102*b* in FIG. 3 have already been charged or pre-filled so that measuring tube 106*a* contains a precisely measured amount chemical from bulk supply 104 and so that measuring tube 106*b* contains a precisely measured amount of DI water. In system 300 shown in FIG. 3, both the chemical in measuring tube 106*a* and the DI water in measuring tube 106*b* are pushed into reservoir 111 by an inert gas such as $N_2$ coupled to port 4 of 6-port valves 102*a* and 102*b*. An exhaust outlet 121 is provided in reservoir 111. System 300, as shown in FIG. 3, enables the precise mixing of a chemical with DI water without the need for a level sensor. It is advantageous to avoid the use of level sensors since they are prone to failure.

Figure 4:
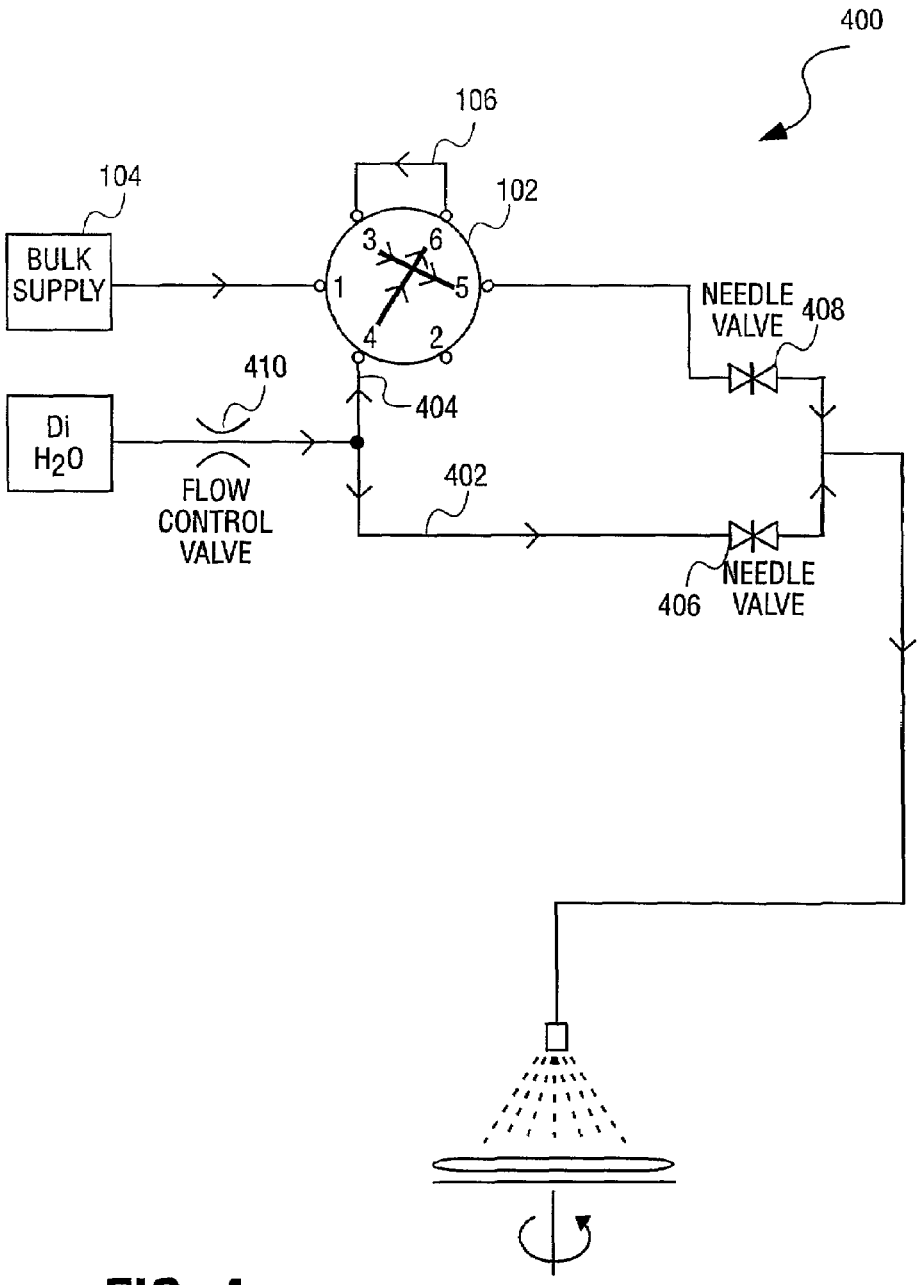
FIG. 4 is an illustration of a mixing apparatus wherein chemical is pushed through a 6-port valve and mixed immediately with a stream of water to combine into a chemical mixture which is sprayed onto a spinning wafer.
Figure 5:
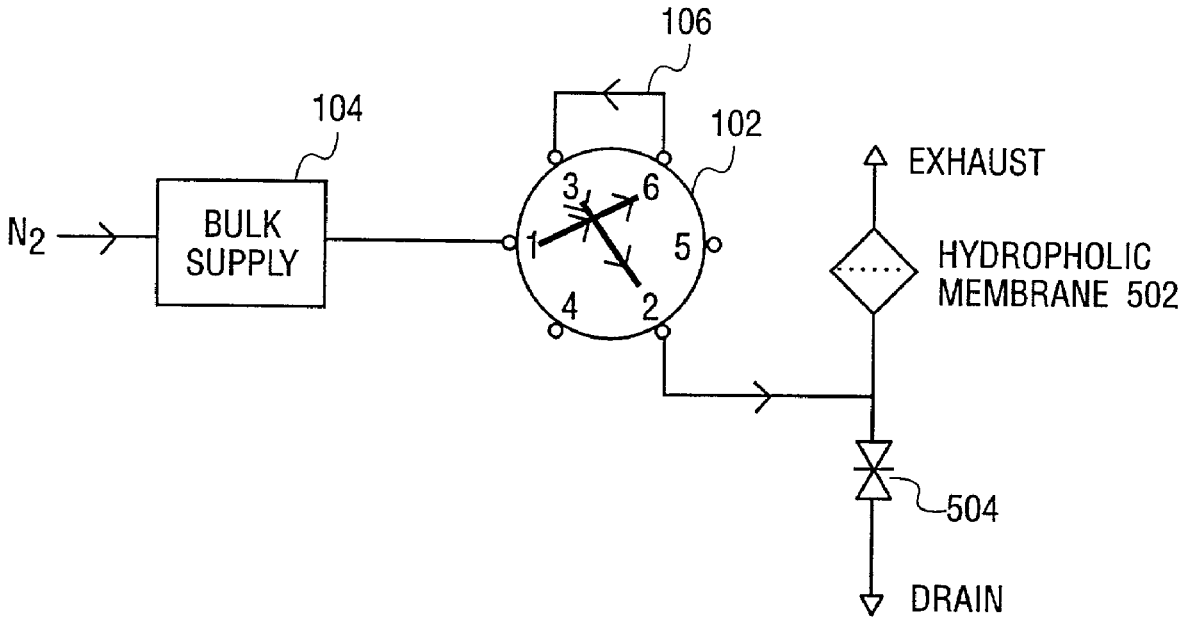
FIG. 5 is an illustration of a gas mixing apparatus wherein a 6-port valve is filled with a chemical and $N_2$ is separated from the chemical using a hydrophobic membrane and a drain valve.
Figure 6:
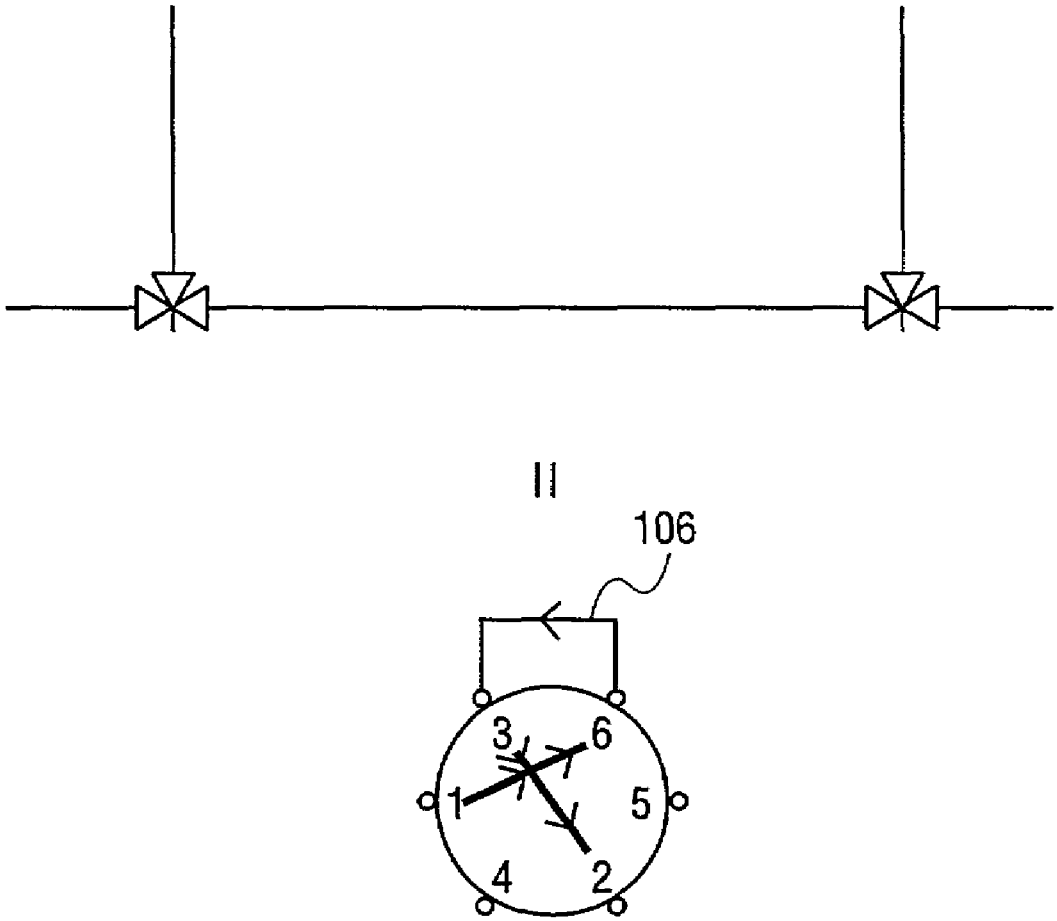
FIG. 6 is an illustration on how two 3-port valves can provide the functionality of a single 6-port valve.

In another system 400 in accordance with an embodiment of the present invention as shown in FIG. 4, no intermediate chamber or reservoir 111 is used. In system 400 DI water splits into two flows, a main flow 402 and flow 404 to port 4 of 6-port valve 102. In FIG. 4 6-port valve 102 is shown in the pre-filled or "charged" position so that measuring tube 106 has a precisely measured amount of chemical from bulk supply 104. The split between the two flows 402 and 404 can be controlled by two needle valves 406 and 408. An advantage of system 400 is that once the chemical is used up, no more etching or cleaning can occur since now only DI water is flowing through both legs. The reaction, therefore, is self limiting. No over exposure can occur. The etch time is determined by the length of measuring tube 106 between ports 3 and 6, and by the flow rate through the 6-port valve. The concentration is determined by the split and flows through the two needle valves. If the flow control valve 410 which controls the total DI water flow is not entirely accurate, the concentration will now deviate in the same amount since the variation occurs equally in both legs and therefore the variations cancel out. In FIG. 5 an improved method and apparatus for filling measuring tube 106 of 6-port valve 102 is illustrated. In FIG. 5 6-port valve 102 is shown in the charging or filling position (e.g. such as FIG. 1). During the filling cycle, a hydrophobic membrane 502 is used to separate the chemicals in bulk supply 104 from the inert gas such as $N_2$ used to push the bulk chemicals. A drain valve 504 can be used to drain any chemicals out of the membrane after filling.

Thus, a method and apparatus for precisely mixing chemicals in a single wafer process has been described. It is to be appreciated that the present invention is not to be limited to the specific details set forth in the preferred embodiment herein. For example, although the present invention has been described with respect to a preferred embodiment where a chemical is mixed with DI water, the present invention is equally useful for mixing any two chemicals. Additionally, although the present invention ideally uses 6-port valves it is to be appreciated that other valving systems, such as two 3-port valves as shown in FIG. 6, which provide the same functionality as a 6-port valve may be used.

We claim:

1. A method of mixing chemicals comprising:

flowing a chemical into a valve system having a tube of a known volume;

filling said tube with said chemical, wherein filling said tube generates a measured amount of said chemical approximately equal to the known volume of the tube;

flowing DI water into a first conduit and into a second conduit, wherein said DI water in said first conduit flows into said tube to push said measured amount of chemical into a third conduit;

combining the flow of said measured amount of chemical and said DI water in said third conduit with said flow of DI water in said second conduit; and dispensing said combined flow onto a spinning wafer.

2. The method claim 1, wherein said valve system comprises a 6-port valve.

3. The method of claim 1, wherein said valve system comprises two 3-port valves.

4. A method of mixing chemicals comprising:

flowing a chemical into a first valve system having a first tube of a known volume and filling said first tube with said chemical to generate a measured amount of said chemical;

flowing DI water into a second valve system having a second tube of a known volume and filling said second tube with said DI water to generate a measured amount of said DI water; and flowing an inert gas into said first and second valve systems to push said measured amount of said chemical and said measured amount of said DI water into a chamber where said measured amount of chemical and said measured amount of DI water are mixed together.

5. The method of claim 4, wherein said first and said second valve systems each comprise a 6-port valve.

6. The method of claim 4, wherein said first and second valve systems each comprise two 3-port valves.

7. The method of claim 4, wherein said first and second valve systems comprise a combination of a 6-port valve and two 3-port valves.

8. A method of generating a measured amount of a liquid chemical in a single semiconductor wafer process comprising:

flowing a liquid chemical into a valve system having a tube of a known volume;

filling said tube with said known volume with said liquid chemical, wherein filling said tube generates a measured amount of said liquid chemical approximately equal to the known volume of the tube;

wherein the said valve system changes from a charging mode of the chemical to a discharging mode of the resulting measured chemical by performing a single change of state of a single multiport valve;

wherein, precisely the measured amount of liquid chemicals is applied by pushing the chemicals out of the tube with a flushing fluid, comprising an inert gas;

separating the measured amount of liquid chemical and the inert gas with a hydrophobic membrane;

applying precisely said measured amount of liquid chemical to a semiconductor wafer in a single semiconductor wafer process; and wherein the applied liquid chemical is of a known measured concentration.

9. The method of claim 8, wherein the said valve system changes from a discharging mode of the resulting measured liquid chemical to the charging mode of the liquid chemical by performing another single change of state of the single multiport valve.

10. The method of claim 8, further comprising the steps of changing the amount of liquid chemical used by changing the volume of said tube.

11. A method of mixing chemicals comprising:

flowing a first chemical into a valve system having a first tube of a known volume and completely filling said first tube with said first chemical to generate a measured amount of said first chemical;

flowing a second chemical through a flow control valve and split into both the valve system and into a first control valve, wherein the second chemical pushes said measured amount of said first chemical, from the valve system, to generate a first chemical mixture, that feeds into a second control valve; and mixing said first chemical mixture from the second control valve and said second chemical from the said first control valve.

12. The method of claim 11, wherein said valve system comprises a 6-port valve.

13. The method of claim 11, wherein said valve system comprise two 3-port valves.

14. The method of claim 11, wherein the said second chemical comprises DI water.

* * * * *